US006238540B1

(12) United States Patent
Timoshenko et al.

(10) Patent No.: US 6,238,540 B1
(45) Date of Patent: May 29, 2001

(54) METHOD FOR MICROPLASMA ELECTROLYTIC PROCESSING OF SURFACES OF ELECTROCONDUCTIVE MATERIALS

(75) Inventors: Aleksandr Vladimirovich Timoshenko; Aleksandr Grigorevich Rakoch, both of Moscow (RU)

(73) Assignee: R-Amtech International, Inc., Bellevue, WA (US)

( * ) Notice: Subject to any disclaimer, the term of this patent is extended or adjusted under 35 U.S.C. 154(b) by 0 days.

(21) Appl. No.: 09/350,167

(22) Filed: Jul. 9, 1999

(30) Foreign Application Priority Data

Apr. 2, 1999 (RU) ..... N 99106051

(51) Int. Cl.[7] ..... C25D 5/00

(52) U.S. Cl. ..... 205/96; 205/106; 205/107; 205/316; 205/326

(58) Field of Search ..... 205/83, 106, 121, 205/316, 326, 107

(56) References Cited

U.S. PATENT DOCUMENTS 3,834,999 9/1974 Hradcovsky et al. ..... 204/56 R
4,869,789 9/1989 Kurze et al. ..... 204/58
5,720,866 2/1998 Erokhine et al. ..... 205/83

FOREIGN PATENT DOCUMENTS 2006531 1/1994 (RU) .

*Primary Examiner*—Kishor Mayekar
(74) *Attorney, Agent, or Firm*—Birch, Stewart, Kolasch & Birch, LLP

(57) ABSTRACT

A method for microplasma electrolytic processing a surface of an electroconductive material, involves establishing an electrical circuit between this material, as a first electrode, and a counterelectrode, as a second electrode, by immersing the first electrode into an electrolyte that is in contact with the second electrode and applying an electrical voltage across the first and second electrodes with a power source. In a first step, only a portion of the surface of the material is immersed in the electrolyte, the size of that portion being dependent on an output power of the power source, a composition of the material, an electric regime used, a composition of the electrolyte, and a minimal current density at which a process of microplasma oxidation is stable. The surface of the material is then completely immersed in the electrolyte while the voltage is regulated to cause a current value I(t) between the first and second electrodes ranging from 0.9I<I(t)1.1I; and then, in a subsequent stage, an electric regime is carried out in which the applied voltage ranges greatly with various changing forms and values of current.

4 Claims, 6 Drawing Sheets

FIG. 3a

Characteristics of the method for microplasma electrolytic processing of surfaces of conductive material Table 1 (Examples 3 to 7)

| Example no. | Treated material, rate at which the coating forms μm/min | Composition of the electrolyte wt% | Step no. | Voltage V | Form of current | Duration of step min. |
|---|---|---|---|---|---|---|
| 1 | 2 | 3 | 4 | 5 | 6 | 7 |
| 3 | Aluminium alloy AL-8, 0.89 | 1) NaOH - 0.3<br>2) $Na[Al(OH)_4]$ - 0.5 | 1 | 590 | 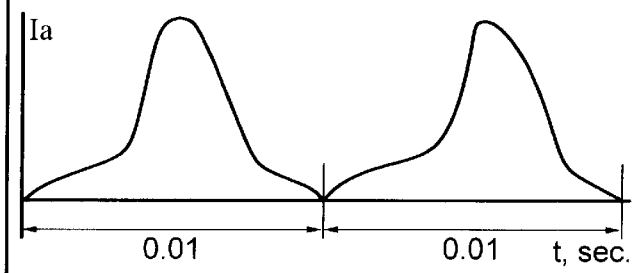 | 7.0 |
| | | 3) Remelted mono-substituted sodium phosphate - 0.5 | 2 | 590 | 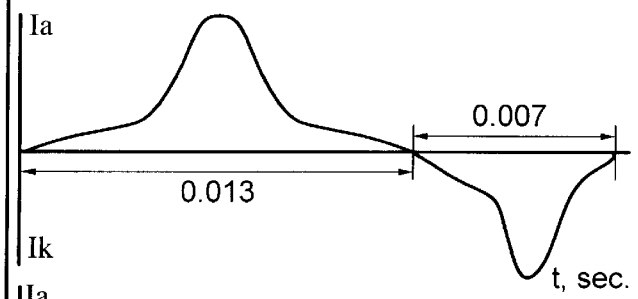 | 33.0 |
| | | 4) Aqueous extract of a raw material of plant origin obtained at a rate ratio of raw material and extract of at least 0.01 - 12.0<br>5) Water - rest | 3 | 580 | 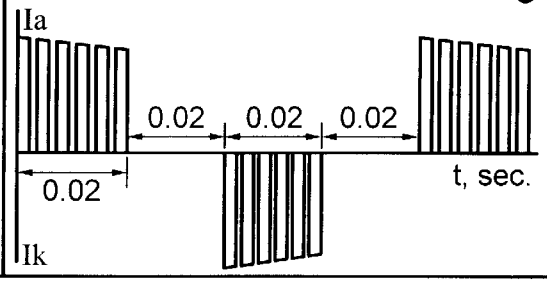 | 10.0 |

| 1 | 2 | 3 | 4 | 5 | 6 | 7 |
|---|---|---|---|---|---|---|
| | | | 4<br>5<br>6<br>7 | 570<br>540<br>510<br>480 | Wave form does not change<br>Wave form does not change<br>Wave form does not change<br>Wave form does not change | 3.0<br>3.0<br>3.0<br>3.0 |
| 4 | Aluminium alloy AD1, 42.50 | 1) $Na[Al(OH)_4]$ - 0.25<br>2) Finely divided powder (not more than 5μm)$TiO_2$ - 100<br>3) Water - rest | 1 | Is increased from 0 to 700 |  | 33.0 |
| 5 | Siliconized graphite, 19.96 | 1) $Na_2SiO_3$ - 4.0<br>2) Water - rest | 1 | 640 |  | 30.0 |
| | | | 2 | 630 |  | 10.0 |
| | | | 3 | 600 | Wave form does not change | 5.0 |
| | | | 4 | 520 | Wave form does not change | 3.0 |

| 1 | 2 | 3 | 4 | 5 | 6 | 7 |
|---|---|---|---|---|---|---|
| 6 | Titan alloy VT 1-0, 1.80 | 1) Sodium sulphate - 0.8<br>2) Sodium aluminate - 0.4<br>3) Sodium tetraborate - 0.3<br>4) Aluminum borate - 0.027<br>5) Water - rest | 1 | 270 |  | 3.0 |
| | | | 2 | 250 |  | 2 |
| | | | 3 | 220 | Wave form does not change | 2 |
| 7 | Aluminum alloy D16, 5.77 | 1) Na OH - 0.3<br>1) $Na_2SiO_3$ - 3.0<br>2) Water - rest | 1 | 640 |  | 7.0 |
| | | | 2 | 640 |  | 53 |
| | | | 3 | 620 | Wave form does not change | 2 |
| | | | 4 | 600 | Wave form does not change | 2 |
| | | | 5 | 580 | Wave form does not change | 4 |

FIG. 4

Characteristics and properties of the generated coating

Table 2

| No of example acc. to table 1 | Thickness of the coating, μm | | Properties of the single layers of the coating | | | | | | | Application of the coating |
|---|---|---|---|---|---|---|---|---|---|---|
| | | | Operating layer | | | | Technological layer | | | |
| | | | | Porosity | | | | Porosity | | |
| | Operating | Technological | Micro-hardness HPA | No of pores on $1cm^2$ | Diameter of pores, μm | Adhesion MPa | Micro-hardness HPA | No of pores on $1cm^2$ | Diameter of pores, μm | |
| 3 | 53±2 | 5±3 | 18.0±1.0 | 3 - 5 | 5 | 370±30 | ----- | ----- | ----- | Wear- and corrosion resistant |
| 4 | 170±±11 | ----- | ----- | 135 - 150 | 90 | Tear across coating | ----- | ----- | ----- | Sublayer for further coating |
| 5 | 720±±20 | ----- | 11.0±1.0 | 0 | ----- | ----- | ----- | ----- | ----- | Gasproof and heat-protecting |
| 6 | 18±±0.5 | ----- | 12.0±2.0 | 7 - 10 | 8 | ----- | ----- | ----- | ----- | Wear- and corrosion resistant |
| 7 | 330±±3.0 | 120±5 | 20.0±2.0 | 4 - 6 | 4 | 370±20 | 0.5±0.1 | 2 - 4 | 3 | Wear- and corrosion resistant (when removing outer layer) |

METHOD FOR MICROPLASMA ELECTROLYTIC PROCESSING OF SURFACES OF ELECTROCONDUCTIVE MATERIALS

FIELD OF THE INVENTION

The invention relates to the field of microplasma electrolytic processing of surfaces of electroconductive materials being metals, alloys and carbonic composites in order to form on their surfaces corrosion-resistant, heat-resistant, and wear-resistant dielectrical coatings. The invention may be applied in such fields as mechanical engineering, aircraft construction, in petrochemical and oil industry. The invention can in particular be used in the manufacturing of large and intricate workpieces the surfaces of which are exposed to aggressive mediums, high temperature, and abrasion; thus, the invention can e.g. be used in the manufacturing of valves of pneumatic devices, and con-rods and cylinders of engines.

BACKGROUND OF THE INVENTION

Known is a method of electrolytic plating the surface of a material, the method including immersion of the treated material, which serves as a first electrode, and of the second electrode in an electrolyte, application of a voltage between them until a plurality of microplasma discharges appears, the micorplasma discharges being evenly spaced across the surface of the treated material, and maintenance of the voltage until a coating of desired thickness is formed. The voltage is increased up to 400 V for basic valve metals and up to 600 V for induced valve metals, the temperature of the electrolyte is maintained in a range of 45–60° C., current density is 250–500 Ma/dm$^2$ [1].

However, this method has some substantial disadvantages:

- low current density entails difficulties in ignition and maintenance of a stable microplasma discharge on the surface of the treated material, in particular for induced valve metals and their alloys, this lowers the quality of the process;
- it is not possible to process intricate workpieces or workpieces having a large surface in the suggested electrical regimes;
- it is not possible to process workpieces made from carbonic materials (graphite or composites made from it).

Known is also a method of electrolytic micro-arc plating of a silicate coating onto a aluminium workpiece [2]. The method comprises steps of forming a coating by preliminary dipping a part into the electrolyte by 5–10% of its surface area at initial current density of anode current, equal to 5–25 A/dm$^2$ and performing further dipping uniformly with a rate, determined by the relation $S/T=0.38+1.93\ i$,
wherein S—total surface of the workpiece, dm$^2$;

T—immersion time, min;

i—initial density of the anode current, A/dm$^2$.

This method has some substantial disadvantages:

- the great thickness of the peripheral technological layer having a relatively porous structure of silicon oxide and aluminium oxide makes it hard to remove it;
- the dependence of the immersion speed of the workpiece on the value of the initial density of the anode current applied works only effectively, if the power values (N) of the power sources used are very low (because $N=I\cdot U$). In this case only workpieces with limited surface can be coated, so that the preliminary immersion by 5–10% still ensures the ignition and stable burning of microplasma discharges. Due to this fact the possibility of coating large workpieces is limited.

The most similar method in terms of the main features is a method for forming coatings by electrolyte discharge[3]. This method for forming relatively thick composite coatings on a region of the surface of a metallic workpiece comprises exposing the surface region to an electrolyte fluid, either by immersion or by spraying the electrolyte against the surface region. A preferred electrolyte fluid is an aqueous solution including an electrolytic agent, a passivating agent and a modifying agent in the form of a solute or a powder suspended in the solution. A voltage signal is applied to induce a current flow of constant magnitude between the metallic member and the electrolyte fluid so that the metallic member interacts with the passivating agent to form a passive oxide layer on the surface region. The voltage signal increases in magnitude until local voltage reaches a breakthrough level across separate highly localized discharge channels along the surface region of the metallic member. At this breakthrough level, localized plasmas including components of the oxide layer and the modifying agent form near the discharge channel and react to form the coating. At some point after the discharges appear, the signal is changed to a series of unipolar anodic pules interspersed with the cathodic pulses which serve to stabilize the growth of the coating.

Thus, the known method comprises the steps of establishing a contact of the material serving as first electrode and of the second electrode with the electrolyte; applying a voltage between the electrodes in the regime of ignition of a plurality of microplasma discharges and maintaining the material in the electrolyte at given electrical parameters, thus, generating a coating of desired thickness.

The substantial disadvantages of this methods are:

- difficulties arise when igniting and maintaining stable microplasma discharges at the same time on large surfaces of a bulky workpiece to be processed or on the surfaces of many small workpieces. Due to this fact the coatings generated do not have uniform thickness and characteristics across the total surface of the workpiece to be processed;
- it is necessary to provide a current source of big power in order to maintain a stable discharge on large surfaces of a bulky workpiece to be treated or on the surfaces of many small workpieces, this entails increased energy expenditure during the process;
- it is not possible to generate coatings of uniform thickness and characteristics across the whole surface of a workpiece having holes or voids or notches with relation of diameter to length being less than 0.3;
- it is not possible to use the method for other non-metallic materials, e.g. graphite or composites made from it.

SUMMARY OF THE INVENTION

The technical objects solved by the present invention are:

- generating a high-quality coating on large surfaces of one bulky workpiece to be treated or on the surfaces of many small workpieces by simplifying the process of ignition of microplasma discharges and maintenance of their stable burning on the surface to be treated during the whole process while using current sources of moderate power;
- obtaining heat-resistant, corrosion-resistant, and wear-resistant dielectric coatings of uniform thickness and characteristics across the total surface to be treated of workpieces and of workpieces with intricate shape, including inner surfaces of holes:

forming a uniform protective coating with a thickness up to 700 $\mu$m on workpieces made from aluminium and its alloys with alloying additions or other valve metals, like zirconium, titan, hafnium and their alloys, but also on those materials like graphite and composites thereof. The coating formed comprises the above mentioned properties.

The above mentioned technical result is achieved by treating the surface of a electroconductive material with a known method of microplasma electrolytic processing, the method including immersion of the surface of the electroconductive material being the anode in the electrolyte fluid or establishing a contact of said first electrode with the electrolyte;

positioning of the second electrode by either immersing it in the electrolytic bath or by using the wall of the bath's body made of electroconductive material as a counterelectrode;

applying an electric regime in the circuit (anode—electrolyte—counterelectrode), including the application of an initial amperage of the polarizing current, maintenance until formation of a coating of required thickness on the surface of the workpiece to be treated, switching off the forming voltage;

taking out the workpiece;

depending on the chemical composition of the electroconductive material and the size of the surface to be treated the contact is established by immersing a portion of the material in the electrolyte, the portion being determined by the equation:

$$S_H = N/A \cdot i \quad (1)$$

wherein $S_H$—is the portion of the workpiece that is immersed in the electrolyte, dm$^2$;

N—is the output power of the power source, Volt·Ampere;

A—is an empiric parameter, depending on the composition of the material to treated, the electric regime used, and the composition of the electrolyte, A=550 to 5000 V;

i—is the minimal current density at which microplasma discharges appear and at which the process of microplasma oxidation is stable, A/dm$^2$.

The value of the minimal current density for the material to be treated is determined by tests. In order to do so a plate is used, the total surface of which ($S_P$) meets the requirement $S_P<S_H$. The plate is completely immersed in the electrolyte, current is applied and increased from 0 to a magnitude at which the process of microplasma processing is stable. The beginning of the process is determined visually when on the surface of the plate bright microplasma discharges appear. The appearance of the micorplasma discharges corresponds to the minimal current value (i). As the area of the plate ($S_P$) is known, the minimal current density can be calculated by the equation: $i=I/S_P$.

Then the material is completely immersed in the electrolyte with a rate, at which the variation of the current applied (I), which is determined by the product of the current density (i) on the whole area (S) to be treated, is less than ±10%, i.e. $0.9\ I<I(t)<1.1\ I$. This restriction is due to the fact that increasing of the current over more than 10% of the calculated value entails local destruction (burn-throughs) of the coating due to the appearance of local microplasma discharges with great power capacity. By decreasing the current to less than 10% the productivity of the process decreases substantially, the microplasma discharges begin to burn unstable and the process may stop.

After the workpiece has been completely immersed in the electrolyte the electric regime is applied; the voltage ranges from 200 to 1000 V with a current of varying forms and values. The relation of the cathode and the anode current at a stabilized voltage is 0 to 1.3 until a coating of a thickness, close to the desired thickness has been formed, then alternating current is applied; the anode impulses or bursts do not exceed 0.04 sec., the pauses between the anode impulses or bursts, in which no current flows, are partly or completely interspersed with cathode impulses, the duration of which is longer, than the duration of the anode impulses or bursts, and the voltage is stepwise decreased until a coating having minimal through-hole porosity and uniform thickness is formed. The maintenance time of the workpiece in the electrolyte at a given electric regime depends on the desired thickness of the coating.

In cases where the area of the material to be treated is quite large (several tens or more dm$^2$) it is expedient to preliminary coat the area or a portion thereof with a dielectric coating in order to facilitate the ignition of microplasma discharges on the surface and to ensure their stable burning. In the second step of complete immersion of the workpiece in the electrolyte, said immersion is performed with a rate, at which the current in the circuit (anode—electrolyte—counterelectrode) is $I(t)=(0.8–0.99)I$, ie. it is close to, but of lower magnitude than the current calculated by the equation:

$$I=N/U \quad (2),$$

wherein

I—maximal current magnitude (A), which can be provided by the source;

N—output power of the source (V·A);

U—value of the stabilized voltage, the magnitude of which is higher than the breakthrough voltage V of the dielectric coating applied.

Sometimes only portions of the workpiece's surface need to be treated; these portions can be located at various places of the workpiece. In this case the various places of the workpiece are previously coated with a dielectric polymeric coating having a different breakthrough voltage. If the break-through voltage of the dielectric coating that was previously applied (e.g. teflon) is higher in magnitude than the stabilized voltage (U) applied, this portion of the surface is not subject to electrolytic microplasma processing. After the electrolytic microplasma process has been completed the dielectric coating can be removed by any known method.

After the workpiece has been completely immersed in the electrolyte an electric regime as follows is applied: a stabilized voltage is applied, which ensures that the relation of the cathode and the anode current does not exceed 1.3, until a coating of a thickness close to the desired thickness has been formed, then an alternating current is applied, wherein the duration of the anode impulses or bursts does not exceed 0.04 sec., and the pauses between the anode impulses or bursts, in which no current flows, are partly or completely interspersed with cathode impulses, the duration of which is longer, than the duration of the anode impulses or bursts, and the voltage is stepwise decreased until a coating having minimal through-hole porosity and uniform thickness is achieved.

The selection of the optimum relation of the anode and the cathode current is determined by the chemical characteristics and chemical composition of the workpiece to be treated, as well as by the specific needs to be satisfied by the coating. When processing carbonic composites, which were produced by impregnating porous graphite with silicon, and using sodium aluminate in the electrolyte, the optimum relation between cathode and anode current is zero.

For achieving wear-resistant coatings on the surfaces of alloys on the basis of zirconium and hafnium in an alkaline electrolyte, to which sodium silicate was added, the optimum relation of cathode to anode current is 1.2 to 1.3. Generally the following may be established. The higher the melting temperature of the metal or alloy to be treated and coating to be formed, the higher the temperature of the microplasma discharge needs to be for good deposition of the coating, this is achieved by a high anode current.

If the pauses between the anode impulses or bursts are less than 0.04 sec., a coating of a thickness close to the desired thickness is formed very quickly. The pauses between the anode impulses or bursts, in which no current flows, are partly or completely interspersed with cathode impulses, the duration of which is longer, than the duration of the anode impulses or bursts. In this case the pores, especially through-pores, are sealed very quickly and the thickness of the coating is equalized. This is due to the fact that microplasma discharges appear in the first instance in local microzones, where the electric resistance is lower than at the rest of the surface.

If it is necessary to generate a coating with a predetermined porosity which can be used as a stable undercoating for subsequent application of protective coatings, decorative coatings or paintings, the electric regime after complete immersion of the workpiece in the electrolyte differs from the regime as described above. In this case before the first step of maintenance a constantly increasing voltage from 0 to 700 to 900 V is applied, wherein the duration of the anode impulses or bursts is equal to or less than the duration of the pauses, in which no current flows, in a range of 0.01 to 0.1 sec.; the currentless pauses after 4 to 10 pauses may be partly or completely filled with cathode impulses or bursts. In this case the formation of pores takes approximately as long as their disappearance. In some cases it is necessary that every 10th currentless pause is filled with cathode impulses or bursts in order to increase the adhesion of the coating to the surface. The periodicity of this filling is determined by the composition of the material to be treated and the composition of the electrolyte. It is not expedient to increase the voltage to more than 900 V, because at this voltage the coating is destroyed due to high energy release in the microplasma discharges.

If it is necessary to generate a porous coating on the surface of a large workpiece, it is expedient to preliminary treat the surface with a dielectric coating (e.g. various polymeric lacquers and adhesives) with a predetermined breakthrough voltage; such treatment provides effective ignition of the microplasma discharges. The thickness of the dielectric coating is selected such that the initial voltage applied is much lower than the voltage at which the process is stopped.

In case the treated workpieces have holes in all various regimes of microplasma processing additional counterelectrodes are placed in the holes. Due to the additional electrodes current shielding inside the holes by the outer surface of the workpiece is avoided. For this aim an effective circulation and cooling of the electrolyte is carried out either by air bubbling and water cooling through the water cooling jacket of the bath, or by pumping the electrolyte at a speed of 1 $dm^3$/min or more out of the bath through a thermoregulator (e.g. a radiator) and back in the bath.

For performing microplasma processing and achieving coatings with desired functional characteristics there are used aqueous solutions, comprising hydroxides, phosphates, aluminates, silicates and other salts of hydroxy acids of alkaline metals, and also complex compounds, including metal in the anion and organic surface-active substances. The most preferred pH range for the aqueous solution of the electrolyte is pH 9 to 13.5. At such pH values the alloys dissolve and aluminium accumulates in the form of aluminate colloid complexes, which at a certain current density are transferred in the discharge channel and aid in the formation of the coating. This process may be activated by adding to the electrolyte finely divided or colloid particles of various chemical composition, such as aluminium oxides, silicon oxides, carbides, nitrites and mixtures thereof. This also aids in the accelerated growth of the coating and the forming of optimum functional characteristics of the coating, as the these compounds are included in the structure of the coating.

If the pH value is<9, the electrolyte has a bad dispersion capability of the electric fields, which emerge when closing the circuit, and high electrical resistance, what entails that the coating does not have uniform thickness and also high energy expenditures.

If the pH value is>13.5, the electrolyte has a high etching capability what leads to a change of the workpiece's geometry or to the situation that microplasma processing is no longer possible.

The usage of salts of hydroxy acids of alkaline metals and of complex compounds, including metal in the anione, in the composition of the electrolyte provides a stable pH value of the electrolyte covering the workpiece to be treated at anode polarisation and also has a modifying effect on the chemical composition of the coating.

Organic surface-active substances, which are absorbed by the surface of the coating to be formed aid in achieving a coating of uniform thickness.

A comparison of the method for microplasma electrolytic processing of surfaces according to the present invention with the closest prior art revealed some unique features, including:

- the method of immersing the workpiece in the electrolyte, which is carried out:
  - a) in two steps: initially a portion of the surface of the workpiece, which is calculated by equation (1), is immersed in the electrolyte, then the workpiece is further immersed in the electrolyte with a rate, at which the variation of the current applied (I), which is determined by the product of the current density (i) and the whole area (S) to be treated, is less than ±10%, i.e. $0.9\ I<I(t)<1.1\ I$.
  - b) by immersing a workpiece, the surface or portions of the surface of which were initially coated with a dielectric coating, with a rate at which the current flowing through the circuit (anode—electrolyte—counterelectrode) is close to, but lower than the magnitude, of the current calculated by equation (2);
- the sequence and character of realizing the electric regime of the microplasma processing;
- the relation of the cathode and the anode current components of the electric regime, the duration of the anode and cathode impulses or bursts and the duration of the pauses between them.

BRIEF DESCRIPTION OF THE DRAWINGS

The invention is now explained with relation to FIGS. 1*a*, 1*b*, 1*c*, 2*a*, 2*b*.

FIG. 1*a*—First step of the electric regime according to example 1

FIG. 1*b*—Second step of the electric regime according to example 1

FIG. 1*c*—Third step of the electric regime according to example 1.

FIG. 2*a*—First step of the electric regime according to example 2

FIG. 2*b*—Second step of the electric regime according to example 2.

FIGS. 3*a*, 3*b* and 3*c* are each different parts of a diagrammatic representation of a Table 1 listing characteristics of example methods 3 through 7 of this invention, showing plots of electrical signals at different steps in the methods.

FIG. 4 is a diagrammatic representation of a Table 2 listing characteristics of generated coatings produced by methods 3 through 7 of FIGS. 3*a*, 3*b* and 3*c*.

DESCRIPTION OF THE PREFERRED EMBODIMENTS

Example 1

By means of microplasma electrolytic processing a coating is applied on the operating element of the chamber of a $CO_2$-laser; the total surface is 2.7 $dm^2$, the material is V-95 alloy. The element has a intricate geometric shape with a hole (d=8 mm). The inner surface of the hole needs to be coated as well. Desired characteristics of the coating:

breakthrough voltage>2000 V;

high chemical stability to the working environment of the laser thickness of the coating—75 $\mu$m.

For carrying out the process of microplasma electrolytic processing a bath having a cubature of 50 l and being made of stainless steel is used. The bath's body serves as counterelectrode.

For carrying out effective cooling and circulation of the electrolyte an air bubbler, which is located at the bottom of the bath, is used. The electrolyte is transferred from the bath through a radiator and back to the bath with a speed of 40 $dm^3$/min. An electrolyte of the following composition (wt %) is used:

1) NaOH—0.3

2) Na [Al $(OH)_4$]-sodium tetrahydroxoaluminate—0.5

3) remelted monosubstited sodium phosphate—0.5

4) Aqueous extract of raw material of plant origin obtained at a rate ratio of raw material and extract of at least 0.01—12.0

5) Water - rest

The output power of the current source is 40000 V·A.

At an initial state the minimum current density, at which the process of microplasma electrolytic process is stable, is determined. For this purpose a plate of V-95 having a surface of 0.6 $dm^2$ alloy is immersed in the electrolyte of the above indicated composition, current is applied and increased until microplasma discharges appear. In the present case the current value determined in the test is I=4.32 A. The minimum current density is 7.2 A/$dm^2$.

Figure 1A:
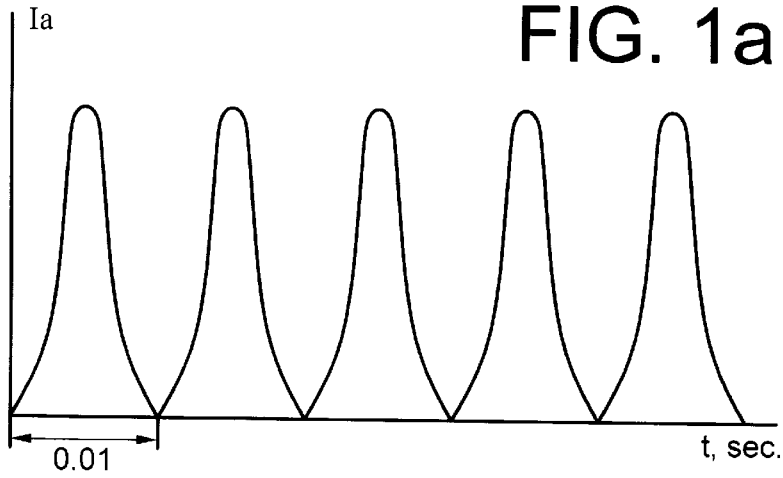
FIGS. 1*a*, 1*b* and 1*c* are timing diagrams showing current flow in the circuit (workpiece to be treated—electrolyte—counterelectrode) in the various steps of the electric regime of the microplasma electrolytic processing of a workpiece according to example 1 (Ia—anode current, Ik—cathode current).
Figure 1B:
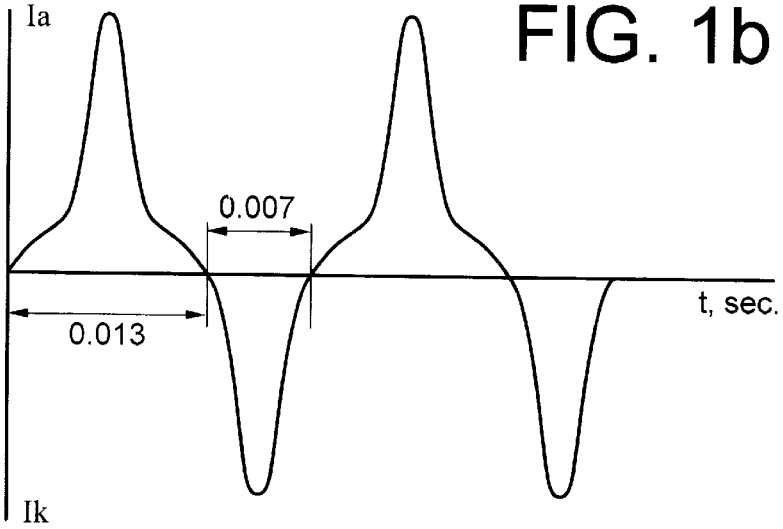
Figure 1C:
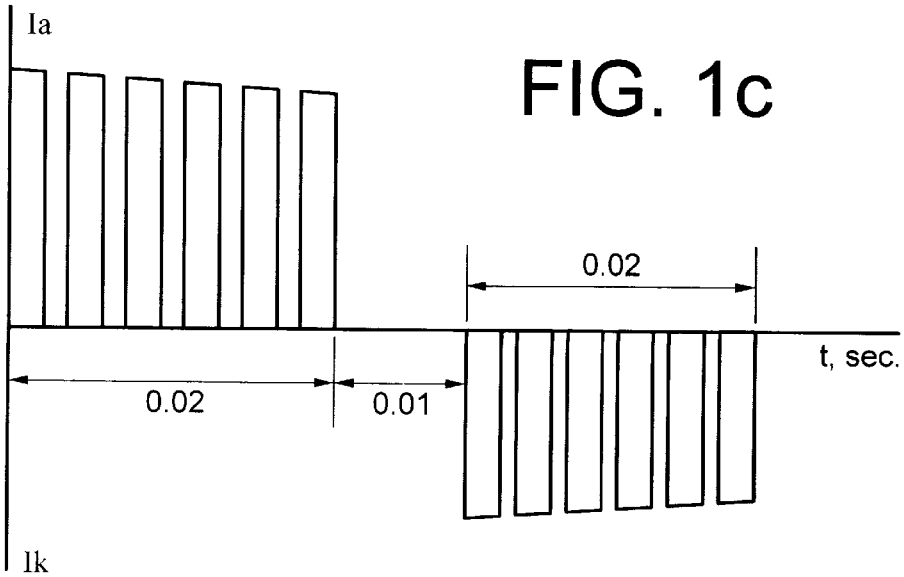

The microplasma treatment is carried out according to the first method of immersion. For this purpose an area of 1.3 $dm^2$ of the operating element of the chamber of the $CO_2$-laser is immersed in the electrolyte. An additional counterelectrode in the form of a bar is placed through the hole of the workpiece. Then a rectified current, the value of which is calculated by the product 7.2 A/$dm^2$·2.7 $dm^2$=19.44 A (the shape of the current is as shown in FIG. 1*a*) is applied and the workpiece is immersed in the electrolyte at a rate, at which the value of the applied current (namely 19.44) does not alter more than ±10%. After the workpiece has been completely immersed in the electrolyte a stabilized voltage (580 V) is applied, which ensures that the relation of the cathode current to the anode current is one (see FIG. 1*b*). The workpiece is maintained in the electrolyte for 30 minutes in the present electric regime; the thickness of the coating formed is 58±10 $\mu$m across the total surface of the workpiece. Then a stabilized voltage of 570 V and pulsed current is applied. The duration of the anode bursts is 0.02 sec., the duration of the pauses, in which no current flows, is 0.01 sec. and the duration of the cathode bursts is 0.02 sec. (see FIG. 1*c*). This electric regime is maintained for 16 min. Then the voltage is decreased in four steps (30 V each time) to 450 V, wherein the first two steps are maintained for four minutes, the second two steps are maintained for two minutes. Then the process is stopped by decreasing the current to zero, the workpiece is taken out of the bath and rinsed with water.

An analysis of the coating formed shows the following:

thickness of the coating—75±6 $\mu$m across the total surface of the workpiece;

through-hole porosity 2..3 pores/$cm^2$, the diameter of the pores does not exceed 1.5 $\mu$m, thus the workpiece has high chemical stability;—the phase composition of the coating is $\alpha Al_2O_3+\gamma Al_2O_3$;

the breakthrough voltage is 2250±50 V.

Example 2

Application of a corrosion-resistant coating on the outer surface of a heat exchanger serpentine pipe, used in chemical apparatus, in particular for the synthesis of ammonia.

The heat exchanger serpentine pipe is made of the zirconium alloy H-2.5, including 2.5% niobia. It has a surface of 15300 $dm^2$ which is in contact with the aggressive environment.

To this end initially a dielectric polymeric coating is sprayed against the outermost surface of the serpentine pipe. The polymeric coating is based on alkyd lacquer and has a thickness of 17±2 $\mu$m. The breakthrough voltage of this coating is 300±20 V. The dielectric coating may also be applied by daubing or with a brush. For realizing the electric regime a current source with an output power of 100000 V·A is used. The bath is made of stainless steel; it's body serves as counterelectrode. It is filled with an electrolyte of the following composition (wt %):

1) $Na_2SiO_3$ 0.6

2) NaOH 0.4

3) Water rest

Preliminary current intensity is calculated according to equation (2); it is 286 A in the present case.

Figure 2A:
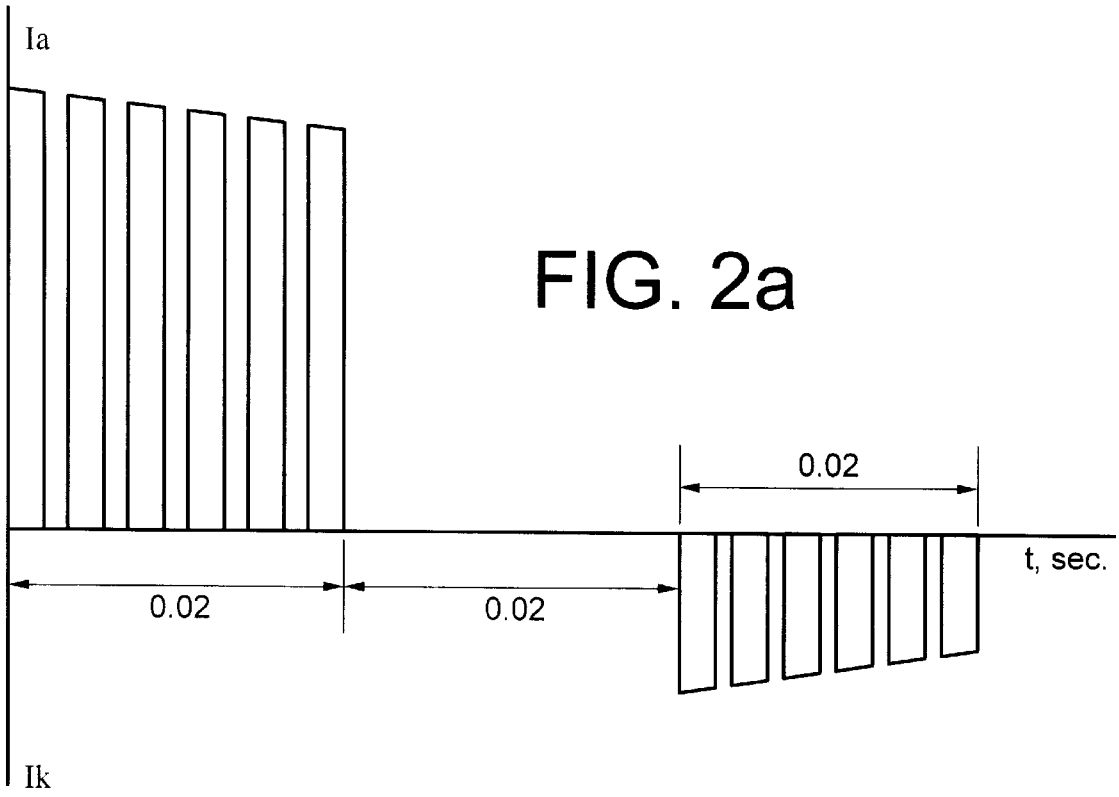
FIGS. 2*a*, 2*b* are timing diagrams showing current flow in the circuit (workpiece to be treated—electrolyte—counterelectrode) in various steps of the electric regime of the micorplasma electrolyte processing of the workpiece according to example 2 (Ia—anode current, Ik—cathode current).

For treatment purposes the serpentine pipe is immersed in the electrolyte with a rate, at which the selected current intensity remains constant. The maintenance of current intensity at a constant level is effected by an automatic feedback control between the immersing device and the power source. At the same time a pulsed voltage of 350 V is applied, the duration of the anode bursts, currentless pauses and cathode bursts is identical, namely 0.02 sec.; the relation of cathode current and the anode current is 0.4 (FIG. 2*a*). At this voltage breakthrough of the preliminary applied dielectric polymeric coating occurs.

Figure 2B:
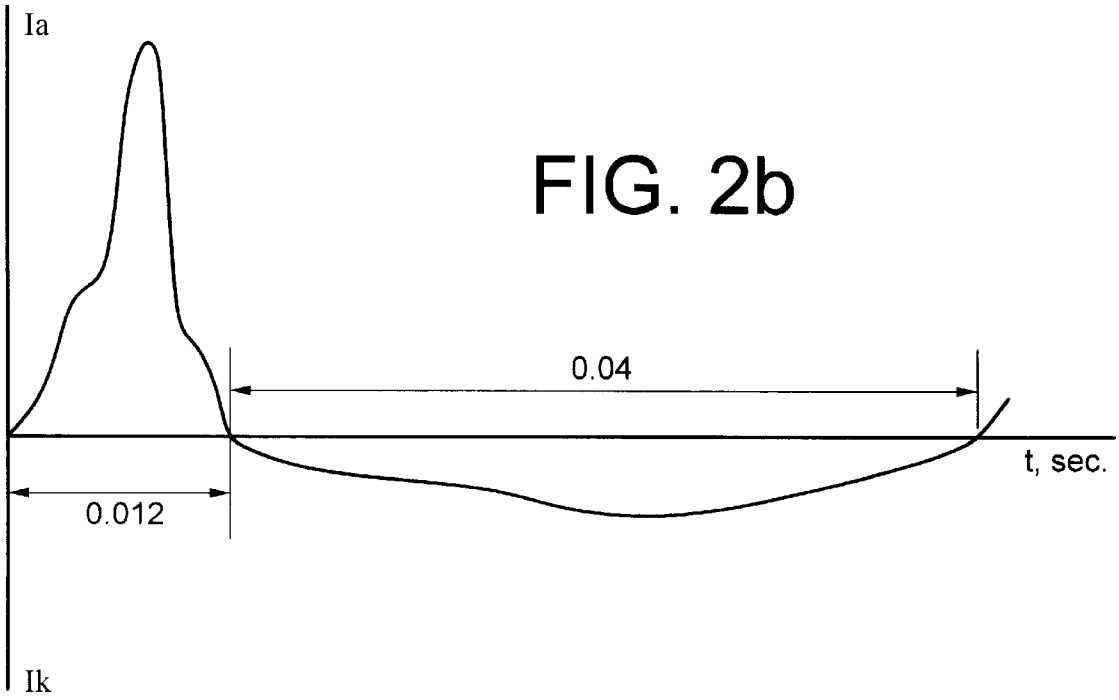
Figure 3B:
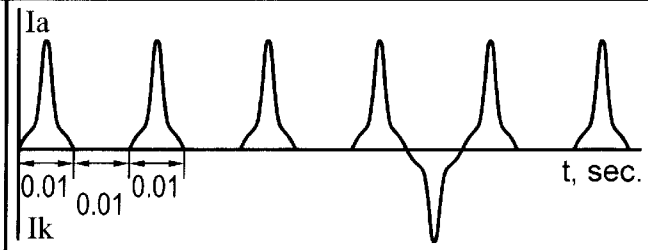
Figure 3B:
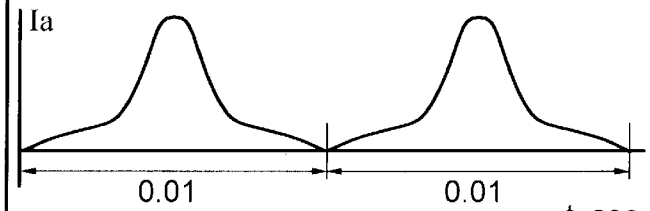
Figure 3B:
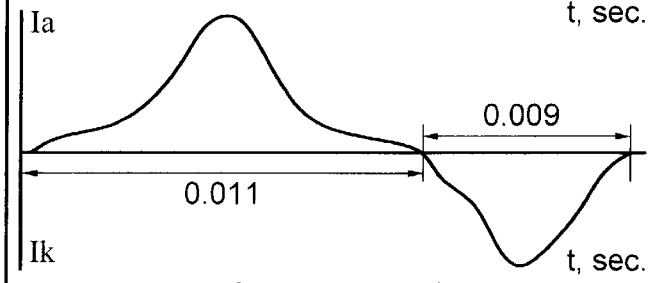
Figure 3C:
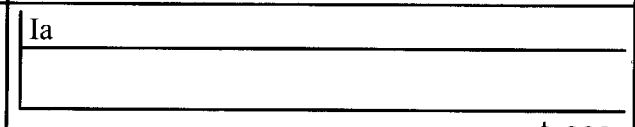
Figure 3C:
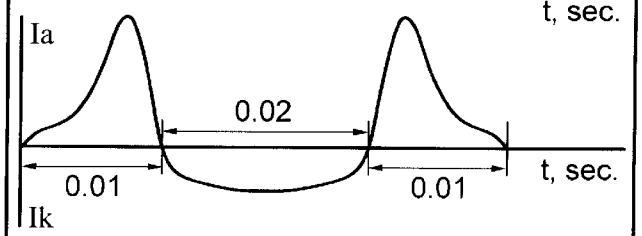
Figure 3C:
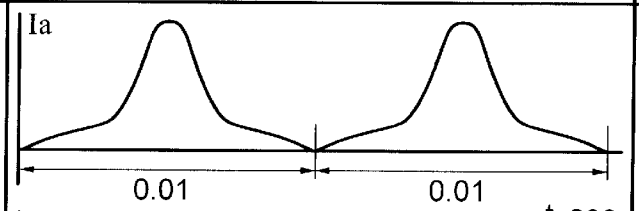
Figure 3C:
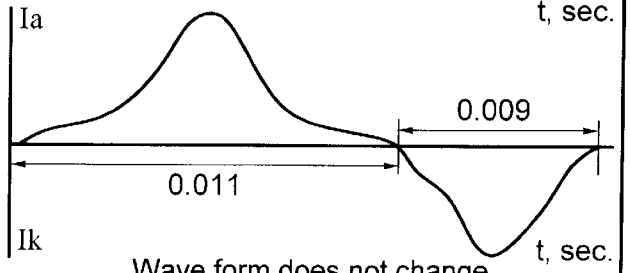

After the pipe has been completely immersed in the electrolyte it is processed in two steps according to the following electric regimes:

first a stabilized voltage of 330 V and a continuous, alternating current is applied; the duration of the anode impulses is 0.012 sec., the duration of the cathode impulses is 0.04 sec. (see FIG. 2*b*). The treatment in the electric regime is carried out for 20 min.;

then the voltage is decreased to 210 V in three steps. At each step the voltage is decreased by 40 V, the steps lasting 3 min. each.

After that the process is stopped by decreasing the current to zero, the work piece is taken out of the bath and rinsed with water.

An analysis of coating formed shows the following:

thickness of the coating—70±5 $\mu$m.

through-hole porosity 1–3 pores/cm$^2$, the diameter of the pores does not exceed 1.5 $\mu$m, thus the workpiece has high corrosion resistance and firmly adheres to the surface;

the phase composition of the coating is $\alpha Al_2O_3+\gamma Al_2O_3$ in the operating layer; and $Al_2SiO_5+\alpha Al_2O_3$ in the technological layer ~10 $\mu$m.

It is understood that it is practically not possible to create a coating having this quality on an area of 15300 dm$^2$ by the known methods of electrolytic microplasma treatment, as the current source would have to have a power of more than 20000000 V·A.

Table 1 shows examples 3 to 7, which illustrate modifications of the microplasma electrolytic processing of electroconductive materials of various chemical composition. The process is carried out in electrolytes of various chemical composition. If flat plates are treated, they are completely immersed in the electrolyte, then processing consisting of a plurality of steps is carried out. In examples 3, 6, 7 the process is initially conducted in the regime of stabilized voltage, with a current density of 11.0; 1.7; 5.5 A/dm$^2$ respectively. In example 5 the voltage is continuously increased up to 640 V in the first step.

The temperature of the electrolyte is maintained constant due to an optimum regime of transferring it out of the bath through a temperature regulating device and back to the bath, the temperature is 16; 25; 110; 25; 30° C. respectively in examples 3; 4; 5; 6; 7.

Table 2 shows the characteristics of the coatings, formed in the regimes according to examples 3; 4; 5; 6; 7.

According to the data as shown in examples 1–7 it is obvious that the method according to the present invention provides the possibility of treating large surfaces of big workpieces or the surfaces of a plurality of small workpieces at the same time, using a power source of medium power. This is unique in comparison with the prior art. The present method is also capable of applying a coating with desired functional characteristics on an enhanced range of materials.

Those skilled in the art will understand that the invention is not limited to the examples given and that it is susceptible of embodiment in many different forms without significantly departing the true spirit and scope of the invention. It is therefore understood that the present specification is not of limited character and it can be changed within the scope of the present invention, limited by the scope of the accompanying claims.

INDUSTRIAL APPLICABILITY

The method according to the present invention provides the possibility of treating large surfaces of big workpieces or the surfaces of a plurality of small workpieces at the same time, using a power source of medium power. It is possible to process electroconductive materials selected from a broad range of materials. The coating applied has desired thickness and functional characteristics.

The broad range of materials that can be selected for the treating agents and devices and the simplicity and reliability of the process according to the present invention aid in the broad industrial applicability of the proposed process.

BIBLIOGRAPHIC DATA OF THE PRIOR ART

1. U.S. Pat. No. 3,834,999 A, Cl. C 23B 11/02, 1974

2. Russian Patent No. 2006531 C I, Cl. C 25D 11/04, 1994

3. U.S. Pat. No. 5,720,866 A, Cl. C 25D 21/12, 1998

We claim:

1. Method for microplasma electrolytic processing a surface of an electroconductive material, the method involving establishing an electrical circuit between this material, as a first electrode, and a counterelectrode, as a second electrode, by immersing the first electrode into an electrolyte that is in contact with the second electrode then applying an electrical voltage across the first and second electrodes with a power source until a plurality of microplasma discharges appear and thereafter maintaining the voltage at given electric parameters for causing a coating of a given thickness on the surface, wherein in carrying out this method:

in a first step, establishing the electrical circuit by first immersing only a portion of the surface of the material in the electrolyte, that portion being determined by the equation:

$$S_H=N/A\cdot i$$

wherein $S_H$—is an area of the portion of the surface that is immersed in the electrolyte, in dm$^2$;

N—is an output power of the power source, in Volt·Ampere;

A—is an empiric parameter, depending on composition of the material, an electric regime used, and a composition of the electrolyte, with A being in a range 550 to 5000 V;

i—is a minimal current density at which a process of microplasma oxidation is stable, in A/dm$^2$ in this first step, the surface of the material in the electrolyte is then completely immersed while the voltage is applied and regulated to maintain a current value I(t) in a range from 0.9 I<I(t)1.1 I, where I is the product of i on a whole area to be treated; and then, in a subsequent stage, carrying out an electric regime in which the applied voltage ranges between 200 to 1000 V, with various changing forms and values of current.

2. The method of claim 1, wherein a second step is carried out as part of the subsequent stage at which a ratio of cathode-polarized to anode-polarized currents is maintained at a stabilized voltage in a range of 0 to 1.3 until a coating of a thickness close to the given thickness has been formed, then in a third step an impulse current is applied which includes anode-polarized impulses that do not last more than 0.04 sec., with pauses between the anode-polarized impulses being at least partly interspersed with cathode-polarized impulses, which do not last longer than the anode-polarized impulses, and the voltage is stepwise decreased until the coating having the given thickness and having minimal through-hole porosity and uniform thickness is formed.

3. The method of claim 1 wherein the surface of the electroconductive material has at least one of holes and notches; an additional electrode is positioned in one of the at least one of holes and notches; and circulation of the electrolyte is carried out.

4. The method of claim 1 wherein an aqueous solution with a pH value of 9 to 13.5 forms the electrolyte.

* * * * *